US005600969A

United States Patent [19]

Low

[11] Patent Number: 5,600,969

[45] Date of Patent: Feb. 11, 1997

[54] PROCESS AND APPARATUS TO PRODUCE A SMALL SCALE LNG STREAM FROM AN EXISTING NGL EXPANDER PLANT DEMETHANIZER

[75] Inventor: William R. Low, Bartlesville, Okla.

[73] Assignee: Phillips Petroleum Company, Bartlesville, Okla.

[21] Appl. No.: 573,973

[22] Filed: Dec. 18, 1995

[51] Int. Cl.[6] ..... F25J 3/06

[52] U.S. Cl. ..... 62/622; 62/623

[58] Field of Search ..... 62/622, 623

[56] References Cited

U.S. PATENT DOCUMENTS

| | | | |
|---|---|---|---|
| 2,775,103 | 12/1956 | Koble et al. | 62/622 |
| 2,952,984 | 9/1960 | Marshall, Jr. | 62/622 |
| 3,242,682 | 3/1966 | English | 62/623 |
| 3,592,015 | 7/1971 | Streich et al. | 62/623 |
| 3,846,993 | 11/1974 | Bates . | |
| 4,065,278 | 12/1977 | Newton et al. | 62/622 |
| 4,115,086 | 9/1978 | Jordan et al. | 62/622 |
| 4,230,469 | 10/1980 | Grimm et al. | 62/623 |
| 4,356,014 | 10/1982 | Higgins | 62/622 |
| 4,430,103 | 2/1984 | Gray et al. . | |
| 4,456,461 | 6/1984 | Perez | 62/622 |
| 4,548,629 | 10/1985 | Chiu . | |
| 4,727,723 | 3/1988 | Durr . | |
| 4,851,020 | 7/1989 | Montgomery, IV . | |
| 4,996,612 | 10/1990 | Bauer | 62/622 |
| 5,309,720 | 5/1994 | Johnson et al. . | |
| 5,325,673 | 7/1994 | Durr et al. . | |

OTHER PUBLICATIONS

Jordan, C. H., 1972. *Chemical Engineering Progress* (vol. 68, No. 9) entitled "Natural Gas Processing at Low Temperatures".

Kinarad, G. E., and Gaumer, L. S. (1973). *Chemical Engineering Progress* (vol. 69, No. 1) entitled "Mixed Refrigerant Cascade Cycles".

Kniel, L. (1973). *Chemical Engineering Process* (vol. 69, No. 10) entitled "Energy Systems for LNG Plants".

Harper, E. A., Rust, J. R. and Lean, L. E. (1975). *Chemical Engineering Progress* (vol. 71, No. 11) entitled "Trouble Free LNG".

Haggin, J. (1992). *Chemical and Engineering News* (Aug. 17, 1992) entitled "Large Scale Technology Characterizes Global LNG Activities" provides background information concerning the relative scale of projects for natural gas liquefaction.

Collins, C., Durr, C. A., de la Vega, F. F. and Hill, D. K. (1995). *Hydrocarbon Processing* (Apr. 1995) entitled "Liquefaction Plant Design in the 1990s" generally discloses basic background information concerning recent developments in the production of LNG.

*Primary Examiner*—Christopher Kilner
*Attorney, Agent, or Firm*—Gary L. Haag

[57] ABSTRACT

This invention concerns a novel process and apparatus for producing relatively small quantities of liquefied natural gas (LNG) by processing a side stream at a conventional NGL expander gas plant.

20 Claims, 2 Drawing Sheets

PROCESS AND APPARATUS TO PRODUCE A SMALL SCALE LNG STREAM FROM AN EXISTING NGL EXPANDER PLANT DEMETHANIZER

This invention concerns a process and apparatus for producing liquefied natural gas (LNG) from a side stream at an NGL expander gas plant.

BACKGROUND

The inherent advantages of employing natural gas as a fuel are becoming more and more apparent in light of increasingly restrictive environmental regulations. One area of significant potential is the use of liquefied natural gas as a transportation fuel. Specific areas of the transportation sector where such use is particularly appealing includes the automotive, trucking and rail sectors. A major problem in employing liquefied natural gas is localized availability and the lack of a delivery network analogous to that existing for conventional liquid fuels. A second problem area is that the development of process technology for natural gas liquefaction has generally focused on world-scale plants capable of producing greater than 400 MMSCF/D of liquefied product. The current invention provides a method and apparatus for producing relatively small volumes of liquefied natural gas on a more localized basis.

It is common practice in the art of processing natural gas to subject the gas to cryogenic treatment to separate hydrocarbons having a molecular weight higher than methane ($C_2$+) from the natural gas thereby producing a pipeline gas predominating in methane and a $C_2$+ stream useful for other purposes. Frequently, the $C_2$+ stream will be separated into individual component streams, for example, $C_2$, $C_3$, $C_4$ and $C_5$+. One such separation process which has received wide spread application in natural gas plants is the turbo expansion process. This process is illustrated in FIG. 1 and is characterized by its overall simplicity.

Representative process conditions for the turbo expansion process are as follows. Feed gas is delivered to the process via conduit 1 at a pressure of about 500 to about 1500 psig and a temperature of about 60° to about 100° F. Water is then removed from the stream by dehydrater 50 thereby producing via conduit 3 a gas product possessing a dewpoint of about or less than −100° F. Conduit 3 is connected to feed gas cooler 52 wherein the stream is cooled via indirect contact with cold residue gas introduced via conduit 23 thereby producing a heated residue stream via conduit 24 and a two-phase cooled stream via conduit 5. The resulting two-phase stream produced via conduit 5 is then routed to separator 54 from which is produced a liquid stream via conduit 7 which is then introduced as feed into a separator stabilizer or demethanizer, a term that is used herein interchangeably by those skilled in the art. The separator stabilizer or demethanizer is a fractionating column with respect to the liquid stream injected via conduit 7. The column possesses both rectifying and stripping sections. The methane-rich vapor stream produced from separator 54 is routed via conduit 9 to turbo expander 58 wherein the stream undergoes pressure reduction and associated cooling thereupon producing energy and a two phase mixture containing appreciable quantities of liquid (ex., 20 wt % liquid) via conduit 11. This two phase mixture is typically at a pressure of about 50 to about 600 psig and a temperature of about 0° to about −180° F. The two phase mixture is introduced into upper section of the stabilizer 56 where it contacts rising vapors and undergoes phase separation thereby producing a methane-rich vapor via conduit 23 and a liquid stream which functions as a reflux stream in the column. Liquid leaves the stabilizer via conduit 13 and is fed to reboiler 60. Heat to the reboiler is usually provided via a heating medium which may be a feed gas side stream. The heating medium is delivered via conduit 17 and returned via conduit 16. Vapor is produced from the reboiler and returned to the stripping section of the stabilizer via conduit 21. A $C_2$+ rich liquid product is produced from the reboiler 60 via conduit 15.

As previously noted, vapor which has also been previously referred to as a cold condensate gas is produced from the top of the stabilizer via conduit 23 and flows to the feed gas cooler 52 wherein this stream is warmed and produced via conduit 24. The contents of this conduit may then be employed as fuel via conduit 25 and/or recompressed via flow through conduit 27 to recompressor 62 wherein power generated via turbo expander 58 is used to compress the gas. This compressed gas is produced via conduit 29. If additional compression is required, additional power may be provided to compressor 62 or the contents of conduit 29 as noted in FIG. 1 may be routed to a separate compressor 64 thereby producing via conduit 31 a gas stream at a greater pressure. Although $C_2$+ recoveries will be dependant on design parameters and desired products, ethane recoveries of up to 90% and propane recoveries of 70 to 99% are possible. Butane and heavier component recoveries of 95 to 100% are possible.

As previously noted, the liquefaction of natural gas is frequently conducted for transport and storage purposes. The primary reason for the liquefaction of natural gas is that liquefaction results in a volume reduction of about 1/600, thereby making it possible to store and transport the liquefied gas in containers of more economical and practical design. For example, when gas is transported by pipeline from the source of supply to a distant market, it is desirable to operate the pipeline under a substantially constant and high load factor. Often the deliverability or capacity of the pipeline will exceed demand while at other times the demand may exceed the deliverability of the pipeline. In order to shave off the peaks when demand exceeds supply, it is desirable to store the excess gas in such a manner that it can be delivered when the supply exceeds demand, thereby enabling future peaks in demand to be met with material from storage. One practical means for doing this is to convert the gas to a liquefied state for storage and to then vaporize the liquid as demand requires.

Liquefaction of natural gas is of even greater importance in making possible the transport of gas from a supply source to market when the source and market are separated by great distances and a pipeline is not available or is not practical. This is particularly true where transport must be made by ocean-going vessels. Ship transportation in the gaseous state is generally not practical because appreciable pressurization is required to significant reduce the specific volume of the gas which in turn requires the use of more expensive storage containers.

In order to store and transport natural gas in the liquid state, the natural gas is preferably cooled to −240° F. to −260° F. where it possesses a near-atmospheric vapor pressure. Numerous systems exist in the prior an for the liquefaction of natural gas or the like in which the gas is liquefied by sequentially passing natural gas at an elevated pressure through a plurality of cooling stages whereupon the gas is cooled to successively lower temperatures until the liquefaction temperature is reached. Cooling is generally accomplished by heat exchange with one or more refrigerants such as propane, propylene, ethane, ethylene, and methane or with mixed refrigerants of given compositions. The refrigerants are frequently arranged in a cascaded manner and each refrigerant is employed in a closed refrigeration cycle. Further cooling of the liquid is possible by expanding the liquefied natural gas to atmospheric pressure in one or more expansion stages. In each stage, the liquefied gas is flashed to a lower pressure thereby producing a two-phase gas-liquid mixture at a significantly lower temperature. The liquid is recovered and may again be flashed. In this manner, the liquefied gas is further cooled to a storage or transport temperature suitable for liquefied gas storage at near-atmospheric pressure. In this expansion to near-atmospheric pressure, significant volumes of liquefied gas are flashed. The flashed vapors from the expansion stages are generally collected and recycled for liquefaction or utilized as fuel gas for power generation.

SUMMARY OF THE INVENTION

It is an object of this invention to develop a process capable of producing small quantities of LNG at a gas plant.

It is a further object of this invention to develop a process capable of producing small quantities of LNG at a gas plant with minimal retrofit to said gas plant and minimal effects on routine gas plant operation.

It is a still further object of the present invention to develop a process and apparatus capable of producing small quantities of LNG at a gas plant where said apparatus is compact in size, reliable, easy to install, and is easy to start-up, operate, and shut-down.

It is still yet a further object of this invention that said process possess reasonable operating costs.

It is yet a further object of this invention that said apparatus and installation costs be reasonable.

In accordance with the present invention, a process for producing liquefied natural gas has been discovered using a methane-rich side stream at an NGL expander plant as the feedstream. The process comprises withdrawing a methane-rich side stream from the gas overhead stream at the demethanizer, expanding said side stream by flowing through a turbo expander thereby producing energy and a two-phase stream, splitting the two-phase stream into a first stream and a second stream, flowing the first stream and a condensible refrigerant stream to a refrigerant condenser wherein said first stream cools and condenses at least a portion of the refrigerant stream via indirect heat exchange thereby producing a liquid-bearing refrigerant stream and a warmed first stream, flashing said liquid-bearing refrigerant stream thereby producing a flashed refrigerant stream, flowing the second stream and the flashed refrigerant stream into a chiller thereby producing via indirect heat exchange with the flashed refrigerant stream an LNG-bearing stream and a refrigerant vapor stream.

Furthermore in accordance with the present invention, an apparatus has been discovered for producing liquefied natural gas from a methane-rich side stream at a gas processing plant, the apparatus comprising a flow conduit for a methane-rich side stream, a turbo expander connected to said flow conduit wherein the temperature and pressure of the methane-rich side stream delivered by the flow conduit are reduced thereby creating a two-phase mixture and energy, a stream-splitting means connected to the turbo expander for separating said two-phase mixture into a first stream and a second stream, a closed refrigeration system nominally comprised of a compressor, a condenser, an expansion means, a chiller, a connection means for interconnecting these components, and a refrigerant, a flow conduit connected to said splitting means for flowing said first stream to said condenser, a flow conduit connected to said splitting means for flowing said second stream to the evaporative chiller, and a flow conduit connected to said chiller from which is produced an LNG-bearing stream.

DESCRIPTION OF THE PREFERRED EMBODIMENTS

The inventive process and apparatus provide a low cost means for producing relatively small quantities of LNG from existing gas plants by processing a methane-rich side stream taken from the overhead vapors of the stabilizer column. This column is also referred to by those skilled in the art as the demethanizer column. For the purposes of this disclosure, the two terms will be used interchangeably. The inventive process and associated apparatus are preferably employed in larger gas plants wherein the removal of the methane-rich side stream does not significantly affect the overall operation of the natural gas liquid (NGL) recovery process.

The inventive process uses several types of cooling which include but are not limited to (a) indirect heat exchange, (b) vaporization and (c) expansion or pressure reduction. Indirect heat exchange, as used herein, refers to a process wherein a cooling agent reduces the temperature of the substance to be cooled without actual physical contact between the cooling agent and the substance to be cooled. Specific examples include heat exchange undergone in a tube-and-shell heat exchanger, a core-in-kettle heat exchanger, and a brazed aluminum plate-fin heat exchanger. The physical state of the cooling agent and substance to be cooled can vary depending on the demands of the system and the type of heat exchanger chosen. Thus, in the inventive process, a shell-and-tube heat exchanger will typically be utilized where the refrigerating agent is in a liquid state and the substance to be cooled is in a liquid or gaseous state, whereas, a plate-fin heat exchanger will typically be utilized where the cooling agent is in a gaseous state and the substance to be cooled is in a liquid state. Finally, the core-in-kettle heat exchanger will typically be utilized where the substance to be cooled is liquid or gas and the cooling agent undergoes a phase change from a liquid state to a gaseous state during the heat exchange.

Vaporization cooling refers to the cooling of a substance by the evaporation or vaporization of a portion of that substance while the system is maintained at a constant pressure. Thus, during the vaporization, the portion of the substance which evaporates absorbs heat from the portion of the substance which remains in a liquid state and hence, cools the liquid portion.

Finally, expansion or pressure reduction cooling refers to cooling which occurs when the pressure of a gas-, liquid- or a two-phase system is decreased by passing through an expansion means. This expansion means may be an expansion valve, a throttle valve or a hydraulic or gas expander. Because expanders recover work energy from the expansion process, lower process stream temperatures are possible upon expansion when expanders are employed, but expanders are generally more expensive to purchase and operate than expansion or throttle valves.

Figure 1:
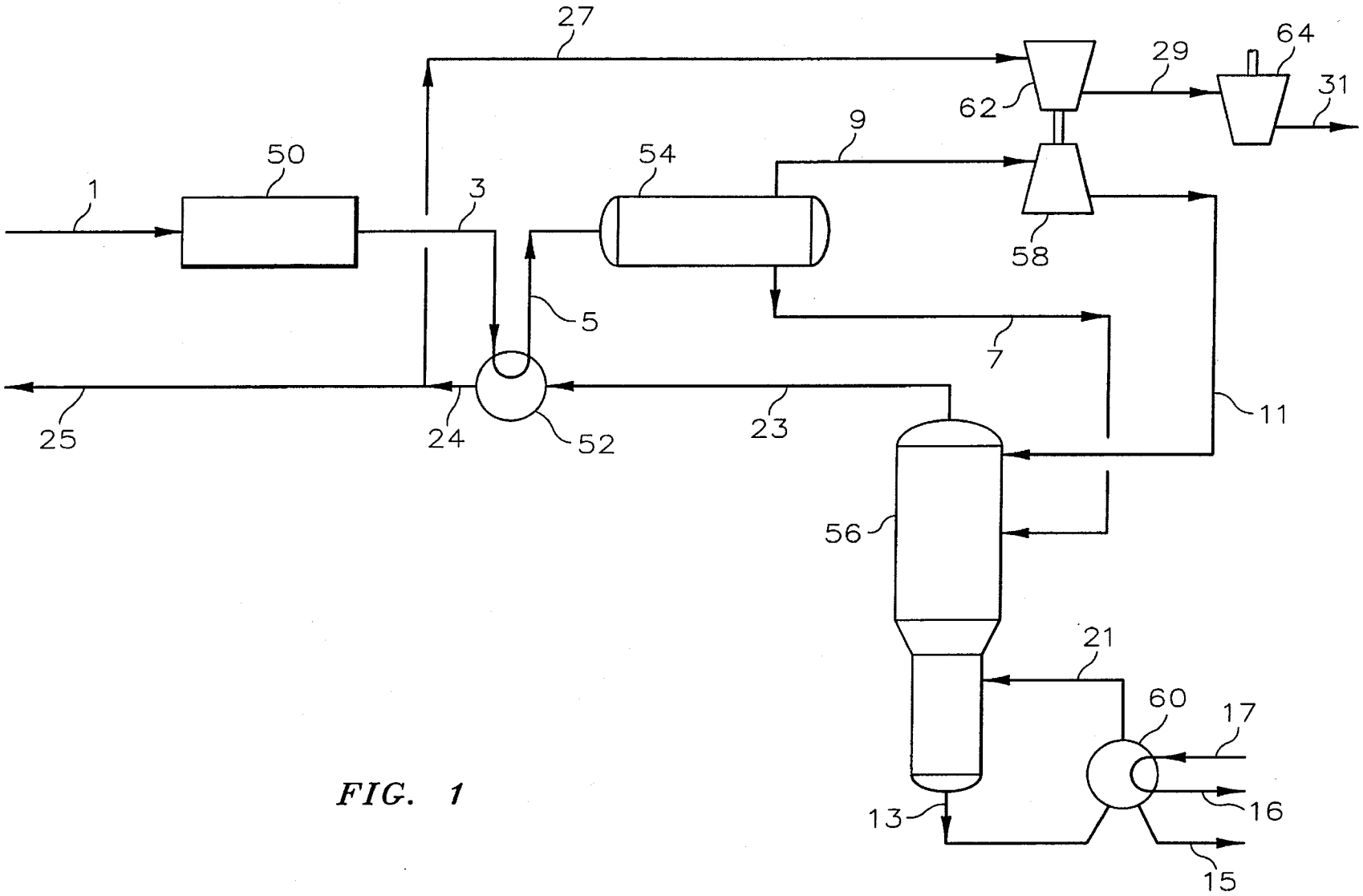
Figure 2:
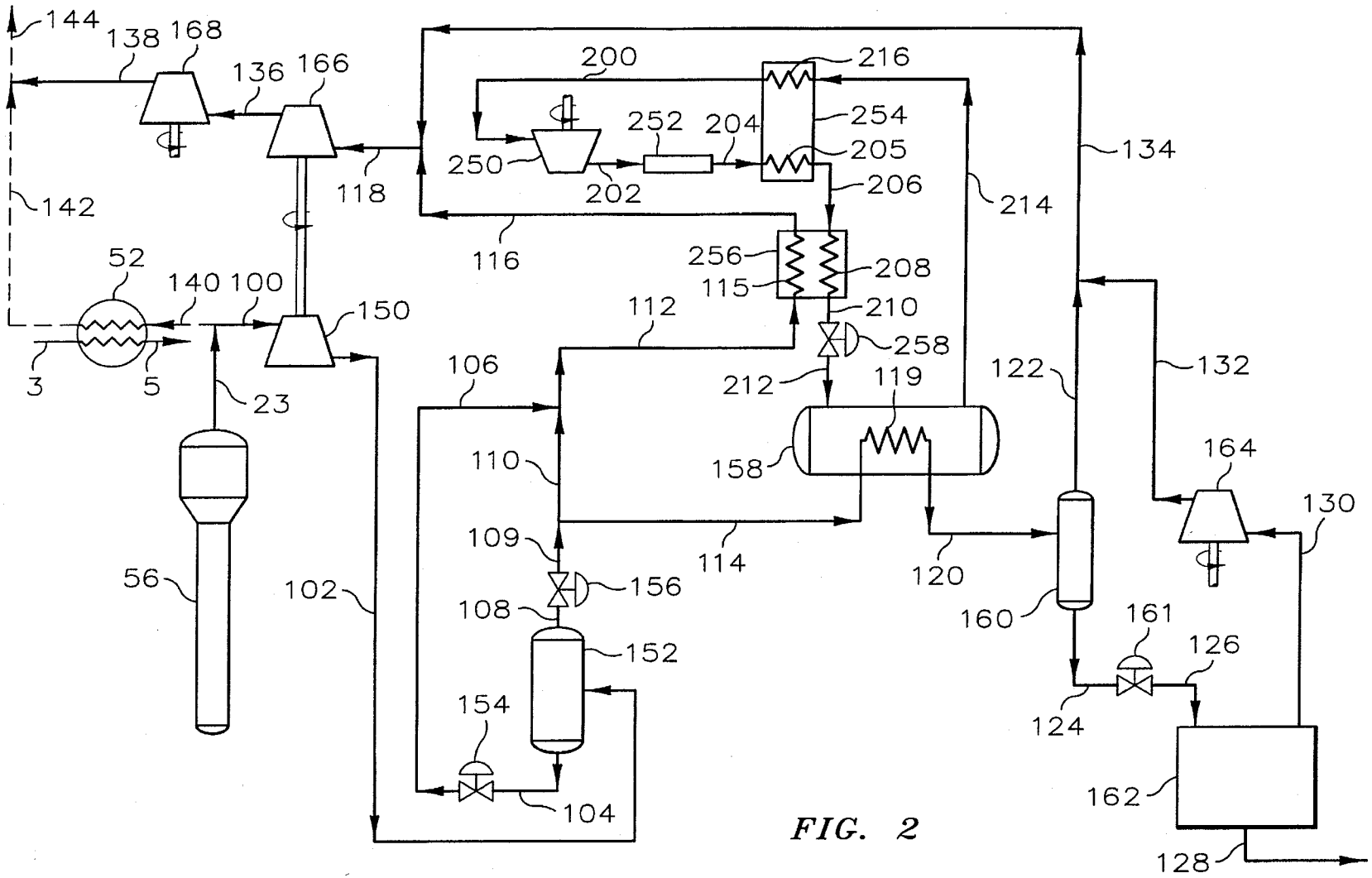

As previously noted and illustrated in FIGS. 1 and 2, the feedstream to the inventive process and apparatus is a methane-rich side stream withdrawn from the overhead vapor stream on a stabilizer column. This side stream which generally possesses a temperature of about −130° F. to about −180° F. and a pressure of 130 to 220 psia, more preferably a temperature of about −152° F. and a pressure of about 160 psia, is expanded by flowing through a turbo expander thereby reducing the stream pressure to 20 to 50 psia, more preferably about 25 to about 40 psia, and most preferably about 32 psia and whereupon the stream temperature is reduced by expansion or pressure reduction cooling and a two-phase stream is produced. It is preferred that the temperature of the two-phase stream be less than −220° F. and more preferably that the temperature be about −230° F. Preferred methane-rich side stream flow rates are 2 to 20 MMSCF/D, more preferably 3 to 7 MMSCF/D, and most preferred is a flow rate of about 5 MMSCF/D.

The two-phase stream produced from the turbo expander is split or separated into a first stream and a second stream by a stream splitting means. In a preferred embodiment, the streams are obtained in the following manner. The two-phase stream from the turbo expander is first routed to a separator means from which is produced a liquids stream which contains the bulk of the ethane and propane present in the methane-rich side stream to the turbo expander and a methane-rich vapor stream. The separator means is preferably a conventional gas-liquid separator. The first and second streams are obtained in the following manner. The methane-rich vapor stream is split into two portions via a stream splitting means. One portion of this stream which consists of approximately 10 to 40%, more preferably 15 to 30% and most preferably about 20 to about 25% of the methane-rich vapor stream becomes the second stream referred to above. The remaining portion of the methane-rich vapor stream becomes the first stream. In another preferred embodiment, the first stream consists of the remaining portion of the methane-rich vapor stream and a portion or all of the liquids stream from the separator means. In either embodiment, the first stream and a condensible refrigerant stream are introduced (i.e., flowed) into a refrigerant condenser wherein said first stream cools and condenses at least a portion of the condensible refrigerant stream via indirect heat exchange thereby producing a liquid-bearing refrigerant stream and a warmed first stream. This refrigerant stream is then flashed via an expansion means thereby producing a flashed refrigerant stream. The second stream and the flashed refrigerant stream are then introduced (i.e., flowed) into a chiller wherein said flashed refrigerant stream cools via indirect heat exchange the second stream thereby producing an LNG-bearing stream and a refrigerant vapor stream. The refrigerant is preferably comprised of methane in a major proportion and more preferably consists essentially of methane. A candidate refrigerant source is the LNG produced by the process.

In another embodiment, a higher BTU content LNG product stream is obtained by routing a portion or all of the liquids stream from the separator to the LNG storage tank. If only a portion of the liquids stream is routed to the LNG storage tank, the first stream and second stream are obtained in the manner set forth in the previous paragraph. If all of the liquids are routed to the LNG tank, the first stream and second stream are then obtained in their entirety from the methane-rich vapor stream from the separation means by splitting said vapor stream in the manner previously described.

The refrigeration system employed in the inventive process is preferably a closed system. The preferred closed refrigeration system is nominally comprised of a compressor, a condenser, an expansion means, a chiller, appropriate connection means for interconnecting these components and a refrigerant. Connection means are those means readily available to one skilled in the art and include but are not limited to the use of tubing, pipe, associated fittings, welded connections, soldered connections and combinations of the preceding. As previously noted, the compressor is situated between the chiller and condenser, is preferably a single-stage compressor, and compresses a refrigerant vapor stream from a relatively low pressure to a higher pressure thereby producing a condensible refrigerant stream. The condenser which is located downstream of the compressor provides at least partial condensation of a condensible refrigerant stream via indirect heat exchange with the first stream from the stream splitting means thereby producing a liquid-bearing refrigerant stream. Preferably, the first stream is prepared from the liquids stream and a portion of the methane-rich vapor stream. An expansion means which is preferably an expansion or throttle valve provides a means for flashing the liquid-bearing refrigerant stream thereby producing a flashed refrigerant stream. The chiller which is preferably an evaporative cooler provides for indirect heat exchange and evaporative cooling between the flashed refrigerant stream and the second stream thereby producing an LNG-bearing stream and the previously mentioned refrigerant vapor stream. The evaporative cooler is preferably a core and shell evaporator chiller. In a preferred embodiment, the refrigeration system employs a refrigerant cooler cooled by an external cooling agent for pre-cooling the condensible refrigerant stream. This cooler is located downstream of the compressor but prior to the condenser. Preferred external cooling agents are those coupled indirectly or directly to an environmental heat sink such as the atmosphere, salt water or fresh water. A preferred refrigerant cooler is an air-fin cooler. In another preferred embodiment, the refrigeration system employs an economizer wherein the refrigerant vapor stream is employed to cool via indirect heat exchange the condensible refrigerant stream. In a still more preferred arrangement, both a refrigerant cooler and economizer are employed wherein the cooler first cools the condensible refrigerant stream followed by additional cooling of this stream by the economizer.

The refrigeration system preferably contains a refrigerant capable of providing cooling of a methane-rich stream to liquefaction temperatures, preferably a temperature of less than −200° F., more preferably a temperature of less than −220° F., and most preferably a temperature of about −230° F., while operating at relatively low pressures, more preferably a maximum refrigerant pressure of less than about 150 psia and most preferably a maximum pressure of about 100 psia. The refrigerant in the refrigeration cycle is preferably comprised of methane in a major proportion and more preferably consists essentially of methane. A candidate refrigerant source is LNG produced via the process.

The LNG-bearing stream from the chiller is separated via a separator means, preferably a conventional gas/liquid separator, into a return vapor stream and a pressured LNG stream. The return vapor stream contains the bulk of the nitrogen originally present in the methane-rich side stream from the stabilizer column. The pressured LNG stream is then flashed by flowing through an expansion means, such means including expanders and valves, preferably an expansion or throttle valve. In one embodiment the resulting stream is flowed to a storage vessel. Produced from the storage vessel is an LNG vapor stream comprised of the vapor from the flash step and vapor from the evaporation of LNG in the storage tank due to heat inleakage. In another embodiment, the stream from the flash step is split via a separation means, preferably a conventional gas/liquid separator, into a flash vapor stream and an LNG product stream. In one aspect of this embodiment, the above cited LNG vapor stream is comprised either in major portion or consists essentially of the flash vapor stream. The LNG product stream is then routed from the separation means to a storage vessel from which is produced a storage vapor stream. The storage vapor stream primarily results from heat inleakage into the storage vessel and subsequent evaporation of LNG product. In another embodiment, the LNG vapor stream previously mentioned is comprised of the flash vapor stream and the storage vapor stream.

The LNG product is stored in the LNG storage vessel at a pressure of near-atmospheric pressure to about 5 psig, more preferably a pressure of near-atmospheric pressure to about 1 psi above atmospheric pressure, and most preferably a pressure of about 0.3 psi above atmospheric pressure. The LNG vapor stream is preferably compressed via a compression means to the pressure of the flash vapor stream and warmed first stream, preferably via a blower, and combined with either, or preferably both the flash vapor stream from the final separator and the warmed first stream produced from the refrigerant condenser thereby producing a combined stream. In one preferred embodiment, the combined stream is compressed by a compressor, preferably driven with power produced by the turbo expander, more preferably the compressor is directly coupled to the turbo expander. If additional compression is desired, additional power can be provided directly to the just mentioned compressor or to a separate compressor which employs external power. The resulting compressed gas stream may then be combined with the remaining portion of the vapor stream from the stabilizer column which preferably has been employed as a coolant for cooling inlet feed gas to the gas plant prior to the initial feed gas expansion. As noted earlier, the stream resulting from this combination may be employed as fuel, place in a low pressure pipeline or further compressed as required prior to placement in a high pressure pipeline.

The inventive process and associated apparatus are capable of converting approximately 15% of the processed side stream to an LNG product containing greater than 99% methane. Because of the simplicity of the system, the process may be easily skid mounted, is easy to operate, is easy to start-up, and thereby particularly amenable to use on a part-time basis thereby providing LNG production if and when demand and/or market conditions so warrant. These capabilities are particularly desirable when operating an automotive, truck or rail fleet on LNG. Additionally, nitrogen present in the methane-rich side stream is not a critical parameter as it is easily removed from the process stream via the separator located downstream of the chiller and upon flashing of the LNG stream to near-atmospheric pressure. Furthermore and as previously discussed, the BTU content of the LNG product may be easily increased by routing a portion or all of the liquids stream collected in the separator downstream of the expander, a stream rich in C2+ components, to the LNG storage tank.

The flow schematic and apparatus set forth in FIG. 2 is a preferred embodiment of the current invention and is set forth for illustrative purposes. Those skilled in the art will recognize that FIG. 2 and previously discussed FIG. 1 are schematics only and therefore, many items of equipment that would be needed in a commercial plant for successful operation have been omitted for the sake of clarity. Such items might include, for example, compressor controls, flow and level measurements and corresponding controllers, additional temperature and pressure controls, pumps, motors, filters, additional heat exchangers, and valves, etc. These items would be provided in accordance with standard engineering practice.

To facilitate an understanding of FIG. 2, items numbered 100–149 refer to process lines or conduits which transport process streams between key vessels and/or process components. Items numbered 150–199 refer to key process vessels or components which are directly associated with the treatment of the methane-rich side stream from the stabilizer. Items numbered 200–249 refer to process lines or conduits in the closed refrigeration cycle which transport refrigerant between key vessels and/or key process components and items numbered 250–299 refer to key vessels or key process components in the closed refrigeration cycle. Finally, items numbered below 100 have been previously defined in the discussion for FIG. 2.

As illustrated in FIG. 2, the overhead vapor from the stabilizer produced via conduit 23 is split into two streams which are respectively conveyed via conduits 100 and 140. The stream in conduit 140 flows to heat exchanger 52 wherein said stream undergoes indirect heat exchange with the gas plant feed gas and is produced via conduit 142. The gas plant feed gas is fed to the heat exchanger via conduit 3 and a cooled feed gas stream produced therefrom via conduit 5. For simplicity, the feed streams to the demethanizer column and the product removal stream are not illustrated. These streams were addressed in the previous discussion of FIG. 1.

The remaining and preferably significantly smaller portion of the overhead vapor from the stabilizer column 56 is a methane-rich stream which is delivered to the turbo expander 150 via conduit 100. A two-phase stream at significantly lower pressure and temperature is produced from the turbo expander via conduit 102 and is fed to the separator 152. A liquids stream and a methane-rich vapor stream are produced from the separator respectively via conduits 104 and 108. Each stream undergoes a slight pressure drop and associated pressure reduction cooling upon flowing across expansion means 154 and 156, preferably valves, and are respectively produced via conduits 106 and 109. The vapor stream present in conduit 109 is then split into a first stream and a second stream delivered via conduits 110 and 114, respectively. The second stream flowing in conduit 114 will become the source of LNG product whereas the first stream will be combined with the liquids stream in conduit 106 and conveyed via conduit 112 to the refrigerant condenser 256 which is part of the refrigeration system. In the condenser, the stream delivered via conduit 112 will function as a coolant via indirect heat exchange means 115, preferably cooling coils. From the refrigerant condenser, this stream will flow in conduit 116 to a point where it will be combined with yet to be described flash vapors.

The balance of the split stream (i.e., the second stream) originally present in conduit 109 and now present in conduit 114 is delivered to chiller 158 wherein the vapor is at least partially condensed via flow through indirect heat exchange means 119. This chiller is preferably a core and shell evaporator. An LNG-bearing stream is produced from the chiller 158 via conduit 120 and is fed to separator 160 from which is produced a return vapor stream via conduit 122 and a pressured LNG stream via conduit 124. The latter stream undergoes a reduction in pressure and temperature upon passing through expansion means 161, preferably an expansion valve, thereby producing a two-phase mixture via conduit 126 which is fed to the LNG storage tank 162. LNG product is produced from tank 162 via conduit 128. Vapor from the flash step occurring in expansion means 161 and from heat in-leakage into the tank 162 is produced via conduit 130 as the LNG vapor stream. This vapor is subsequently compressed via a compression means, preferably a blower, blower 164, and produced via conduit 132. The vapor contents of conduits 132 and 122 are subsequently combined and are transporting via conduit 134 which is further combined with the previously described contents of conduit 116. This combined stream is transported via conduit 118 to recompressor 166 wherein the stream is compressed using energy made available via turbo expander 150. Compressed vapors leaves recompressor 166 via conduit 136. The contents in this conduit may then be further compressed via compressor 168 to a pressure sufficient that the compressed product to be delivered via conduit 138 and combined with the stream delivered via conduit 144, that conduit containing the major portion of the stabilizer vapor. The combined flows present in conduits 138 and 142 are produced via conduit 144. As previously noted, possible uses for this gas stream include use as fuel, returning to a low pressure pipeline for transportation or compressing to a higher pressure and retuning to a high pressure pipeline.

The final key element in FIG. 2 is the closed refrigeration system. As previously noted, a first stream is delivered via conduit 112 functions as a coolant and condenses the majority of the remaining refrigerant vapor, preferably all of the refrigerant vapor, fed to the condenser 256 via conduit 206 which is connected to an indirect heat transfer means 208 which is situated in close proximity to heat exchange means 115. This fluid then flows from the indirect heat exchange means 208 to an expansion means 258, preferably an expansion valve, via conduit 210. Upon passing through expansion means 258, a two-phase refrigerant mixture is obtained at significantly lower temperature and pressure. This mixture is delivered to the evaporative chiller 158 via conduit 212. Refrigerant vapor is produced from the evaporative chiller via conduit 214 whereupon said fluid functions as a coolant via an indirect heat transfer means 216 in heat exchanger 254 and is subsequently produced from said vessel via conduit 200. In another embodiment, the two-phase mixture from expansion means 258 is fed to a separator thereby producing a liquid stream which is fed to the evaporative chiller and a vapor stream which is combined with the vapor stream from the evaporative chiller and thereby becomes the vapor stream in conduit 214. The vapor in conduit 200 is delivered to compressor 250, preferably a single-stage compressor, whereupon said vapor undergoes an increase in pressure and temperature and is produced via conduit 202 which is connected to a cooler 252, preferably a water or air cooler, most preferably an air fin cooler. The vapor produce from cooler 252 then flows to previously mentioned heat exchanger 254 whereupon it undergoes cooling via flow through indirect heat transfer means 205 which is situated in close proximity to previously mentioned indirect heat transfer means 216. Cooled vapor is produced from heat exchanger 254 via conduit 206 to previously mentioned condenser 256.

While specific methods, materials, items of equipment and control instruments are referred to herein, it is understood that such specific recitals are not to be considered limiting but are included by way of illustration and to set forth the best mode in accordance with the present invention.

EXAMPLE I

This Example shows the unexpected ease with which a gas plant designed for removing natural gas liquids can be modified and become an efficient producer of liquefied natural gas.

The simulation results to be presented in this example were obtained using Hyprotech's Process Simulation HYSIM, version 386/C2.10, Prop. Pkg PR, the process flowsheet illustrated in FIG. 2 was the basis of the simulation.

Presented in Tables 1–4 are specifics concerning the process simulation. The simulation demonstrates that with a total power input of only 356 HP, the inventive process can produce 793 MSCF/D (87.08 lb mole/hr) of LNG. This corresponds to an LNG production efficiency of greater than 2 MSCF/HP-D. The simulation results show that approximately 16% of the methane-rich stream removed from the stabilizer column is converted to a liquefied natural gas product possessing a temperature of –260° F. and a pressure of 15 psia. The power input corresponds to a very efficient 462HP-D/MMSCF.

TABLE 1

TEMPERATURE, PRESSURE, AND FLOWRATE OF KEY PROCESS STREAMS BY LINE DESIGNATION

| Line No. | Temperature (°F.) | Pressure (psia) | Flowrate (lb mole/hr) | Vapor Fraction |
|---|---|---|---|---|
| 100 | –152 | 160 | 549.0 | 1.0000 |
| 102 | –222 | 37 | 549.0 | 0.9787 |
| 104 | –222 | 37 | 11.68 | 0.0000 |
| 106 | –226 | 32 | 11.68 | 0.0164 |
| 108 | –222 | 37 | 537.3 | 1.0000 |
| 109 | –223 | 32 | 537.3 | 1.0000 |
| 110 | –223 | 32 | 413.7 | 1.0000 |
| 112 | –224 | 32 | 425.4 | 0.9754 |
| 114 | –223 | 27 | 123.6 | 1.0000 |
| 116 | –108 | 27 | 425.4 | 1.0000 |
| 118 | –119 | 27 | 461.9 | 1.0000 |
| 120 | –248 | 27 | 123.6 | 0.2591 |
| 122 | –248 | 27 | 32.02 | 1.0000 |
| 124 | –248 | 27 | 91.56 | 0.0000 |
| 126 | –260 | 15 | 91.56 | 0.0489 |
| 128 | –260 | 15 | 87.08 | 0.0000 |
| 130 | –260 | 15 | 4.47 | 1.0000 |
| 132 | –218 | 27 | 4.447 | 1.0000 |
| 136 | –45 | 49 | 461.9 | 1.0000 |
| 138 | 122 | 150 | 461.9 | 1.0000 |

TABLE 2

POWER REQUIREMENTS OF KEY PRIME MOVERS

| Prime Mover No. | Power (HP) |
|---|---|
| 150 | 110 (output) |
| 164 | 1 |
| 166 | 105 |
| 168 | 250 |
| 250 | 110 |

TABLE 3

HEAT TRANSFER DUTIES BY PROCESS VESSEL

| Process Vessel. | Heat Transfer Duty (MMBTU/HR) |
|---|---|
| 158 | 0.341 |
| 252 | 0.164 |
| 254 | 0.193 |
| 256 | 0.456 |

TABLE 4

TEMPERATURE, PRESSURE, AND FLOWRATE OF KEY REFIGERATION STREAMS BY LINE DESIGNATION

| Line No. | Temperature (°F.) | Pressure (psia) | Flowrate (lb mole/hr) | Vapor Fraction |
|---|---|---|---|---|
| 200 | −10 | 17 | 107.6 | 1.0000 |
| 202 | 282 | 100 | 107.6 | 1.0000 |
| 204 | 120 | 90 | 107.6 | 1.0000 |
| 206 | −91 | 85 | 107.6 | 1.0000 |
| 210 | −217 | 80 | 107.6 | 0.0000 |
| 212 | −250 | 22 | 107.6 | 0.1352 |
| 214 | −231 | 22 | 107.6 | 0.9994 |

That which is claimed:

1. A process for producing liquefied natural gas at a natural gas expander plant comprising (a) withdrawing a methane-rich side stream from the gas overhead stream at the demethanizer;

(b) expanding said side stream by flowing through a turbo expander thereby producing energy and a two-phase stream;

(c) splitting said two-phase stream into a first stream and a second stream;

(d) flowing said first stream and a condensible refrigerant vapor stream to a condenser wherein said first stream functions via indirect heat exchange as a coolant thereby condensing at least a portion of the condensible refrigerant stream and producing a liquid-bearing refrigerant stream and a warmed first stream;

(e) flashing said refrigerant stream of step (d) thereby creating a flashed refrigerant stream;

(f) flowing the second stream and at least a portion of the flashed refrigerant stream into an indirect heat exchange means thereby condensing at least a portion of the second stream and producing an LNG-bearing stream and a refrigerant vapor stream.

2. A process according to claim 1 wherein the refrigerant comprises methane in major proportion.

3. A process according to claim 1 wherein the refrigerant is the condensed product of step (f).

4. A process according to claim 1 additionally comprising the steps of (g) compressing the refrigerant vapor stream of step (f) thereby producing said condensible refrigerant stream of step (d); and (h) cooling said condensible refrigerant stream by first flowing through a cooling means coupled to an environmental sink prior to employing said stream in step (d).

5. A process according to claim 4 wherein the refrigerant comprises methane in major proportion.

6. A process according to claim 4 wherein the refrigerant is the condensed product of step (f).

7. A process according to claim 4 further comprising the step of (i) contacting via indirect heat exchange means the refrigerant vapor stream of step (f) with the cooled refrigerant stream of step (h) prior to introducing said stream to step (d).

8. A process according to claim 7 wherein the refrigerant comprises methane in major proportion.

9. A process according to claim 7 wherein the refrigerant is the condensed product of step (f).

10. A process according to claim 7 additionally comprising the steps of (j) separating the LNG-bearing stream of step (f) into a return vapor stream and a pressured LNG stream; and (k) compressing said flash vapor stream using energy from step (b).

11. A process according to claim 10 additionally comprising the step of (l) flashing the liquid-bearing stream of step (d) to a pressure of near-atmospheric pressure to 5 psig;

(m) flowing the flashed product of step (l) to a storage vessel wherefrom is produced a storage vapor stream;

(n) compressing said storage vapor stream to a pressure approximately equivalent to the pressure of the return vapor stream;

(o) combining said compressed stream of (m) with said return vapor stream of step (j); and (o) feeding this combined stream to step (k) above.

12. A process for producing liquefied natural gas at an natural gas expander plant comprising (a) withdrawing a methane-rich side stream from the gas overhead stream at the demethanizer;

(b) expanding the side stream by flowing through a turbo expander thereby producing energy and a two-phase stream;

(c) separating said two-phase stream into an expanded vapor stream and an expanded liquid stream;

(d) splitting said expanded vapor stream into a first vapor stream and a second vapor stream;

(e) cooling a refrigerant vapor stream in a closed refrigerant stream by indirect heat exchange with said first vapor stream thereby producing an at least partially condensed refrigerant and a heated first vapor stream;

(f) flashing said partially condensed refrigerant; and (g) cooling said second vapor stream via indirect heat exchange by contact with at least a portion of the product of step (f) thereby producing a second refrigerant vapor and an at least partially condensed natural gas stream.

13. A process according to claim 12 additionally comprising (h) combining said first vapor stream and at least a portion of said expanded liquid stream and employing this stream in place of the first vapor stream in step (e).

14. An apparatus for producing liquefied natural gas from a methane-rich side stream at a gas processing plant comprising (a) a first conduit for the methane-rich side stream;

(b) a turbo expander connected to the first conduit of (a);

(c) a splitting device connected to the turbo expander and from which is produced a first stream and a second stream;

(d) a closed refrigeration system nominally comprised of a compressor, condenser, an expansion means, a chiller, necessary refrigerant conduit for connecting the above components in an operational order, and refrigerant;

(e) a second conduit from said splitting means for delivering the first stream coolant to said condenser;

(f) a third conduit from said splitting means for delivering said second stream to said evaporative chiller;

(g) and a fourth conduit from said chiller from which is produced an LNG-bearing stream.

15. An apparatus according to claim 14 wherein said closed refrigeration system is additionally comprised of a refrigerant cooler coupled to an environmental heat sink inserted in the conduit between the compressor and the condenser.

16. An apparatus according to claim 15 wherein said closed refrigeration system is additionally comprised of an economizer inserted in the conduit between the evaporator and the compressor and the conduit between the refrigerant cooler and the condenser.

17. An apparatus according to claim 16 additionally comprising (h) a fifth conduit connected to said condenser providing for flow of a warmed first stream from condenser;

(h) a gas/liquid separation means connected to said conduit of (g) from which is produced a return vapor stream and a pressured LNG stream;

(i) a sixth conduit connected to said gas/liquid separation means of (h) for said return vapor stream;

(j) a seventh conduit connected to said fifth and sixth conduits through which the combined streams delivered by the fifth and sixth conduits flow; and (k) a compressor connected to said seventh conduit employing power generated at least in part by the turbo expander of (b) thereby compressing said stream delivered by the seventh conduit.

18. An apparatus according to claim 17 wherein said turbo expander of (b) and compressor of (k) are directly coupled to one another.

19. A apparatus according to claim 17 additionally comprising (l) an expansion means;

(m) an 8th conduit connected to the separation means of (h) and the expansion means of (l) through which the pressured LNG stream flows;

(n) an LNG storage vessel;

(o) a ninth conduit situated between the expansion means of (m) and the LNG storage vessel of (n);

(o) a vapor blower;

(p) a tenth conduit situated between the LNG storage vessel of (m) and the vapor blower of (o) through which flows the vapor storage stream; and (q) an eleventh conduit situated connected to the blower of (o) and to either the fifth conduit, the sixth conduit, or the seventh conduit.

20. An apparatus according to claim 19 wherein said turbo expander of (b) and compressor of (k) are directly coupled to one another.

* * * * *